US011084049B2

(12) United States Patent
Wang

(10) Patent No.: US 11,084,049 B2
(45) Date of Patent: Aug. 10, 2021

(54) PAINT SPRAY GUN

(71) Applicant: Hsing-Tzu Wang, Taichung (TW)

(72) Inventor: Hsing-Tzu Wang, Taichung (TW)

( * ) Notice: Subject to any disclaimer, the term of this patent is extended or adjusted under 35 U.S.C. 154(b) by 147 days.

(21) Appl. No.: 16/161,485

(22) Filed: Oct. 16, 2018

(65) Prior Publication Data

US 2019/0381526 A1 Dec. 19, 2019

(30) Foreign Application Priority Data

Jun. 14, 2018 (TW) ..... 107120558

(51) Int. Cl.

| | |
|---|---|
| ***B05B 1/30*** | (2006.01) |
| ***B05B 7/02*** | (2006.01) |
| ***B05B 7/24*** | (2006.01) |
| ***B05B 11/00*** | (2006.01) |

(52) U.S. Cl.

CPC ..... *B05B 1/3046* (2013.01); *B05B 7/02* (2013.01); *B05B 7/241* (2013.01); *B05B 11/0054* (2013.01)

(58) Field of Classification Search

CPC ..... B05B 7/02–129; B05B 7/24–32; B05B 1/3046; B05B 11/0054; B05B 9/01; B05B 7/1481

USPC ..... 239/414–416, 527–528, 337

See application file for complete search history.

(56) References Cited

U.S. PATENT DOCUMENTS

| | | | | |
|---|---|---|---|---|
| 4,426,039 | A * | 1/1984 | Kwok | B05B 7/1209 239/415 |
| 8,066,205 | B2 * | 11/2011 | Bass | B05B 7/066 239/526 |
| 8,882,000 | B2 | 11/2014 | Mehta | |
| 2012/0217318 | A1 | 8/2012 | Mehta | |

FOREIGN PATENT DOCUMENTS

| | | | |
|---|---|---|---|
| GB | 290438 | A | 5/1928 |
| GB | 333908 | A | 8/1930 |
| JP | 4898282 | B2 | 3/2012 |
| KR | 20050012458 | A | 2/2005 |

OTHER PUBLICATIONS

Search Report issued to European counterpart application No. 19151656.6 by the EPO dated Jul. 31, 2019 (9 pages).

Search Report appended to an Office Action, which was issued to Chinese counterpart application No. 201910030023.X by the CNIPA dated Sep. 17, 2020, with an English translation thereof (4 pages).

* cited by examiner

*Primary Examiner* — Joseph A Greenlund
*Assistant Examiner* — Juan C Barrera
(74) *Attorney, Agent, or Firm* — Hamre, Schumann, Mueller & Larson, P.C.

(57) ABSTRACT

A paint spray gun includes a gun body formed as a unitary one piece structure composed of a tubular body portion, a valve connection portion, an air passageway portion and a feed connection portion. A spray cap is disposed on the tubular body portion and has a cap opening. The tubular body portion has an air chamber that is covered by the spray cap and that communicates with said cap opening, and a feed (Continued)

passage connected to the chamber. The valve connection portion, the air passageway portion and the feed connection portion are formed as one piece with the tubular body portion without welded joints.

7 Claims, 11 Drawing Sheets

PAINT SPRAY GUN

CROSS-REFERENCE TO RELATED APPLICATION

This application claims priority of Taiwanese Patent Application No. 107120558, filed on Jun. 14, 2018.

FIELD

The disclosure relates to a spray gun, and more particularly to a paint spray gun.

BACKGROUND

FIGS. 1 and 2 illustrate a conventional paint spray gun, which includes a gun body 1, a nozzle 2 disposed on a front end of the gun body 1, a needle member 3 movably disposed in the gun body 1 and extending through the nozzle 2, an air valve assembly 4 disposed in the gun body 1 for providing high air pressure input, a paint cup 5 attached to the gun body 1, and a trigger 6 pivotally connected to the gun body 1. The gun body 1 has a main body 101, a valve tube 102 welded to the main body 101 in connection with the air valve assembly member 4, an air passageway member 103 welded between the main body 101 and the valve tube 102, a feed tube 104 welded to the main body 101, and a trigger connection member 105 welded to the main body 101. A bottom side of the main body 101 has an air feed hole 106. A front side of the valve tube 102 has an air valve hole 107. The air passageway member 103 is hollow and has a communication space 108 communicating with the air feed hole 106 and the air valve hole 107. The air valve assembly member 4 is connected to the valve tube 102. The trigger 6 is pivotally connected to the trigger connection member 105. The paint cup 5 is connected to the feed tube 104.

When the needle member 3 is actuated by the trigger 6 to open the nozzle 2 such that the air valve assembly member 4 is transitioned from a close state to an open state, high pressure air enters a front inner space of the main body 101 through the air valve assembly member 4, the air valve hole 107, the communication space 108 and the air feed hole 106. When the high pressure air is sprayed out of the nozzle 2, negative pressure around the nozzle 2 produces a suction force that draws paint from the paint cup 5 and atomizes it through the nozzle 2 onto an object (not shown) for being painted.

However, the conventional pain spray gun may encounter the following disadvantages during use or manufacture:

1. Because the main body 101, the valve tube 102, the air passageway member 103, the feed tube 104 and the trigger connection member 105 are welded together for forming the gun body 1, it is required to perform multiple welding steps which are troublesome and increase manufacture costs. In case of faulty welding operation, it can affect the appearance and quality of painted products.

2. If the valve tube 102 and the main body 101 are poorly welded to each other, or if the air passageway member 103, the main body 101 and the valve 102 are poorly welded together, poor welded joints can tend to leak. High pressure air input from the air valve assembly member 4 around the nozzle 2 can be instable or insufficient, and the paint can be unevenly or insufficiently atomized. Uneven atomization can affect aesthetic appearance and integrity of painted products. In addition, leakage at poor weld joints can impose extra load on an air compressor (not shown) and waste energy.

3. If the feed tube 104 and the main body 101 is poorly welded to each other, paint may leak from poor weld joint of the feed tube 104 and the main body 101. In addition, external air can be mixed with the paint through the poor weld joint and form air bubbles therein. During a paint spraying operation, paint can be intermittently atomized, causing rough or incomplete atomization of the paint, which adversely affect aesthetic appearance of the painted products.

4. Generally, the gun body 1 is welded by using silver. Therefore, the gun body 1 has to be made from copper. Because an aluminum alloy cannot be used for manufacturing the gun body 1, the weight of the gun body is unable to be reduced.

SUMMARY

Therefore, an object of the disclosure is to provide a paint spray gun that can alleviate at least one of the drawbacks of the prior art.

According to the disclosure, a spray gun includes a gun unit, a spray unit, an air valve unit and an operation unit.

The gun unit includes a gun body, a spray cap and a nozzle. The gun body is formed as a unitary one piece structure composed of a tubular body portion, a valve connection portion, an air passageway portion and a feed connection portion. The spray cap is disposed on a tubular front end of the tubular body portion and has a cap opening. The tubular body portion has an air chamber that is disposed inside the tubular front end and covered by the spray cap and that communicates with the cap opening, and a feed passage connected to a rear end of the air chamber. The valve connection portion is integrally formed with and extends downwardly from a bottom side of the tubular body portion. The valve connection portion has a valve connecting hole. The air passageway portion is integrally formed with and extends downwardly from the bottom side of the tubular body portion and connects the valve connection portion, and has an air passageway in fluid communication with the valve connecting hole and the air chamber. The feed connection portion is integrally formed with and extends upwardly from a top side of the tubular body portion, and has a feed inlet hole in communication with the feed passage. The nozzle is received in the spray cap and has a nozzle tip extending into the cap opening. The nozzle fluidly communicates the feed passage and fluidly disconnects the air chamber.

The spray unit includes a spray needle that extends in the feed passage and the nozzle tip. The spray needle is movable axially within the tubular body portion between a non-delivery position, where the spray needle closes the nozzle tip, and a delivery position where the spray needle opens the nozzle tip.

The air valve unit is connected to the valve connection portion. The air valve unit is transitionable between a closing state where the air valve unit has no fluid communication with the valve connecting hole, and an opening state where the air valve unit is in communication with the valve connecting hole.

The operation unit is disposed on the gun body. The operation unit drives the spray needle to move between the non-delivery position and the delivery position, and actuates the air valve unit to transition between the closing state and the opening state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
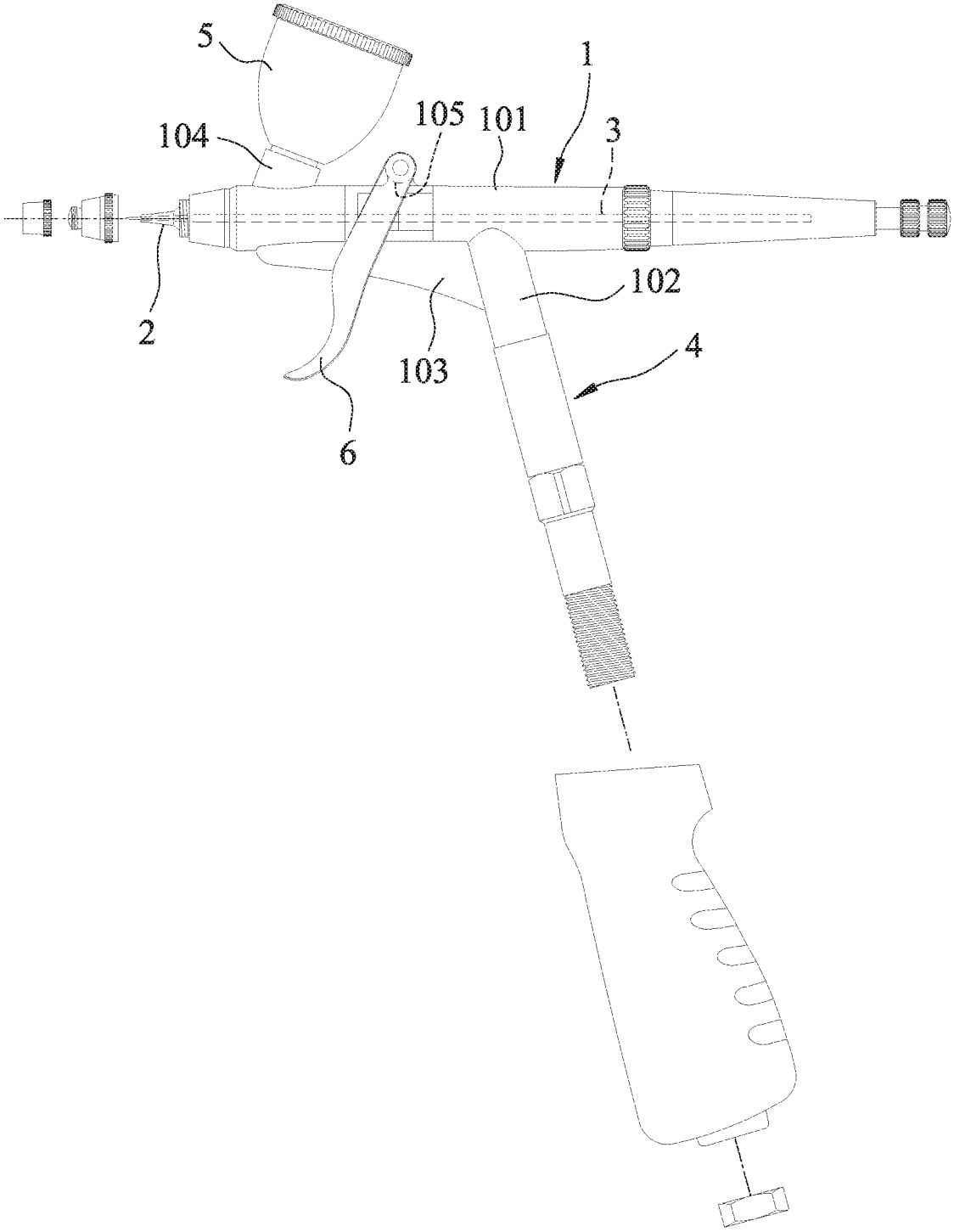
FIG.1 PRIOR ART
FIG. 1 illustrates a conventional paint spray gun.
Figure 2:
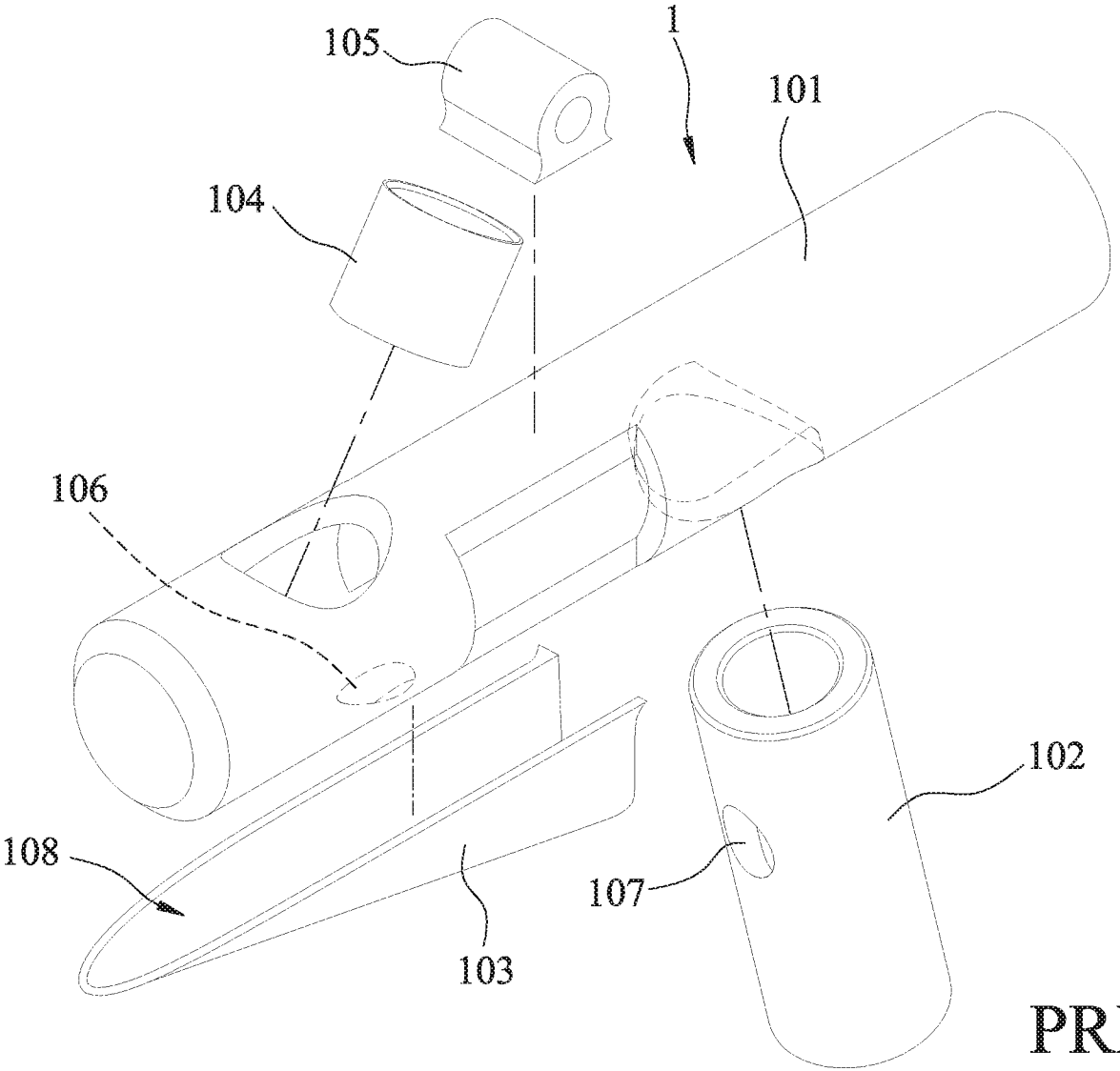
FIG.2 PRIOR ART
FIG. 2 is a partly exploded perspective view of the conventional paint spray gun.
Figure 3:
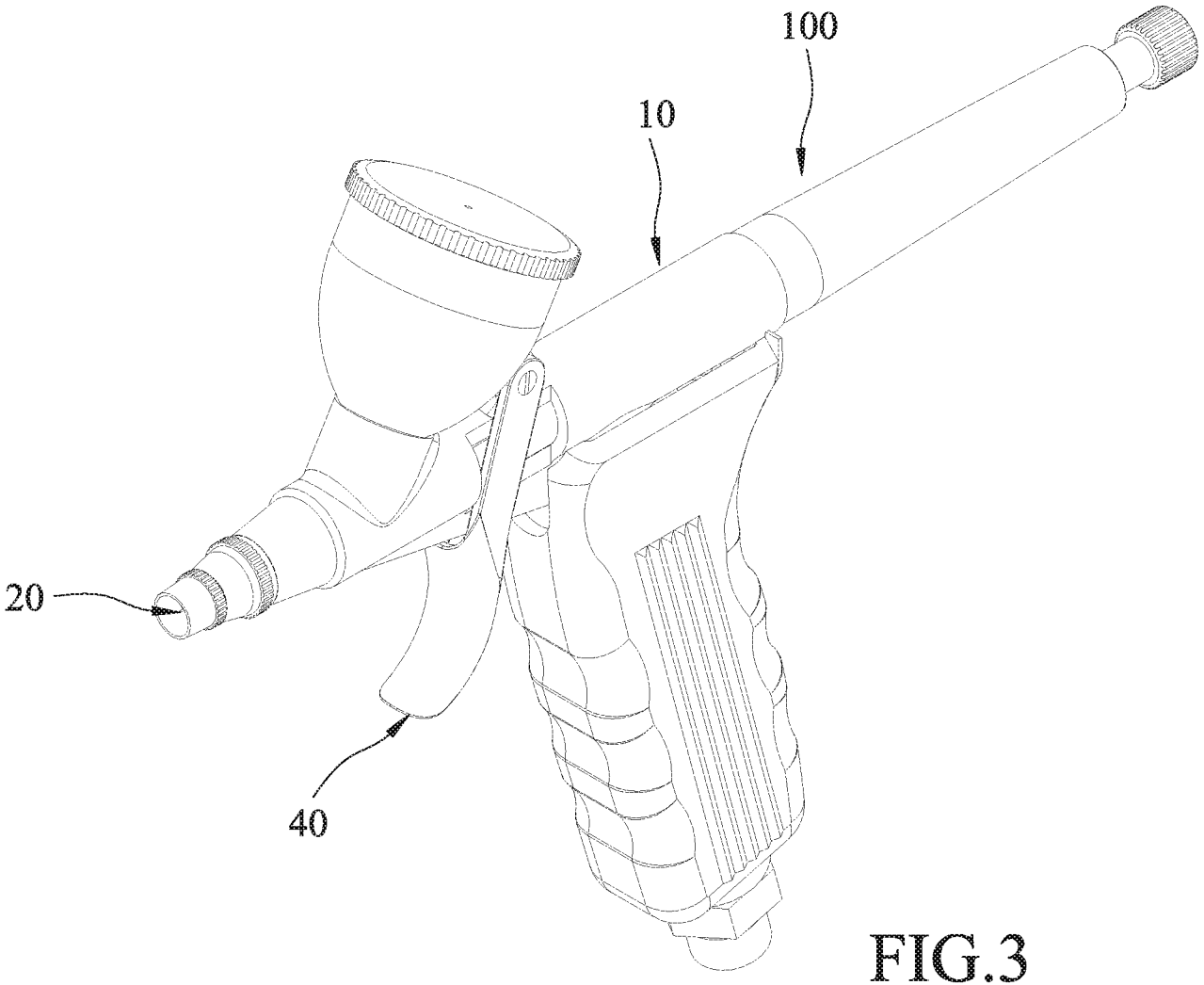
FIG. 3 is a perspective view illustrating an embodiment of a paint spray gun according to the disclosure.
Figure 4:
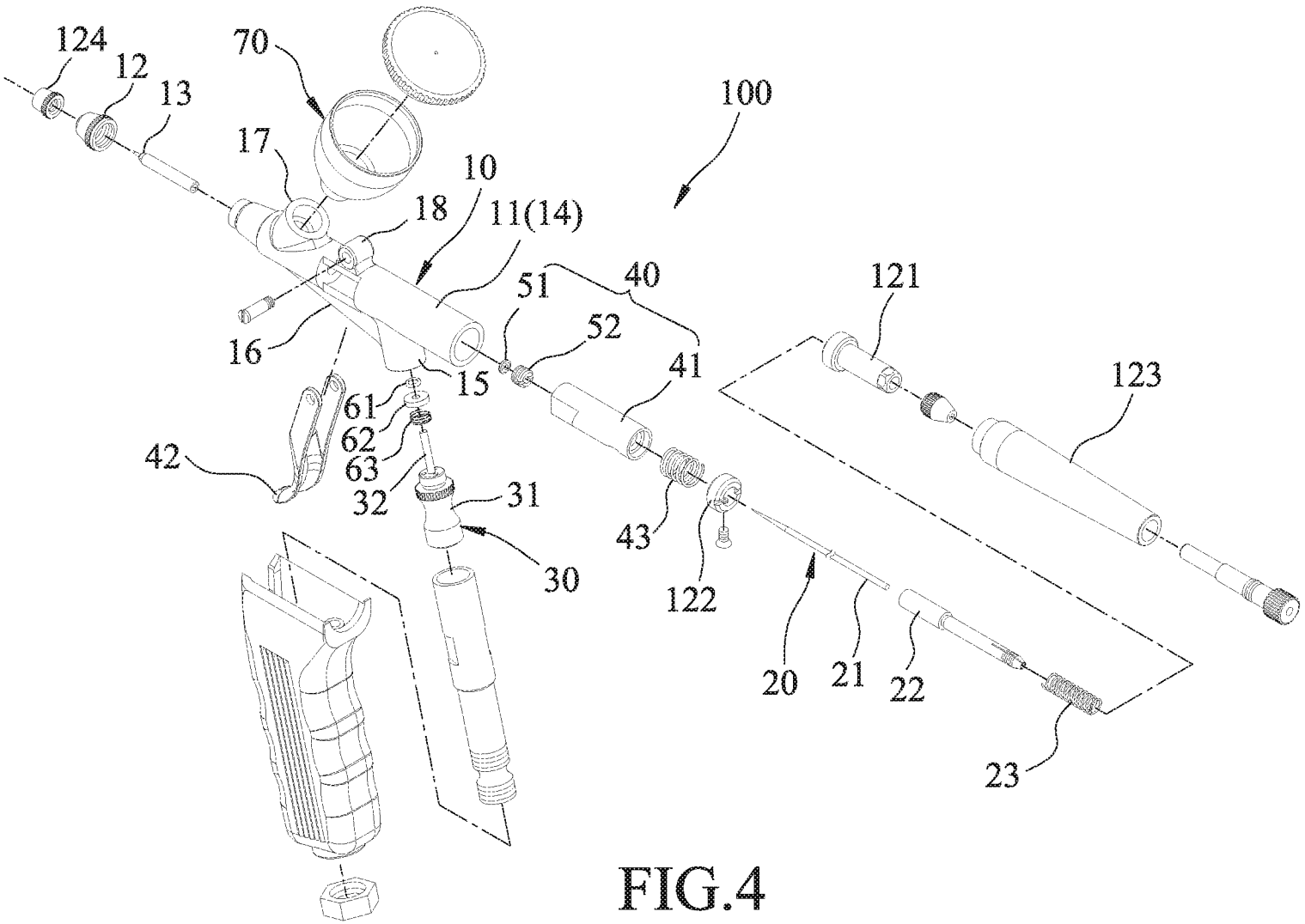
FIG. 4 is an exploded perspective view of the embodiment.

FIGS. 3 to 4 illustrate an embodiment of a paint spray gun 100 according to the disclosure. The paint spray gun 100 includes a gun unit 10, a spray unit 20, an air valve unit 30, an operation unit 40 and a paint cup 70.

The gun unit 10 includes a gun body 11, a spray cap 12, a spring cap 121, a stop member 122, a tail cap 123, a needle cap 124 and a nozzle 13.

Figure 5:
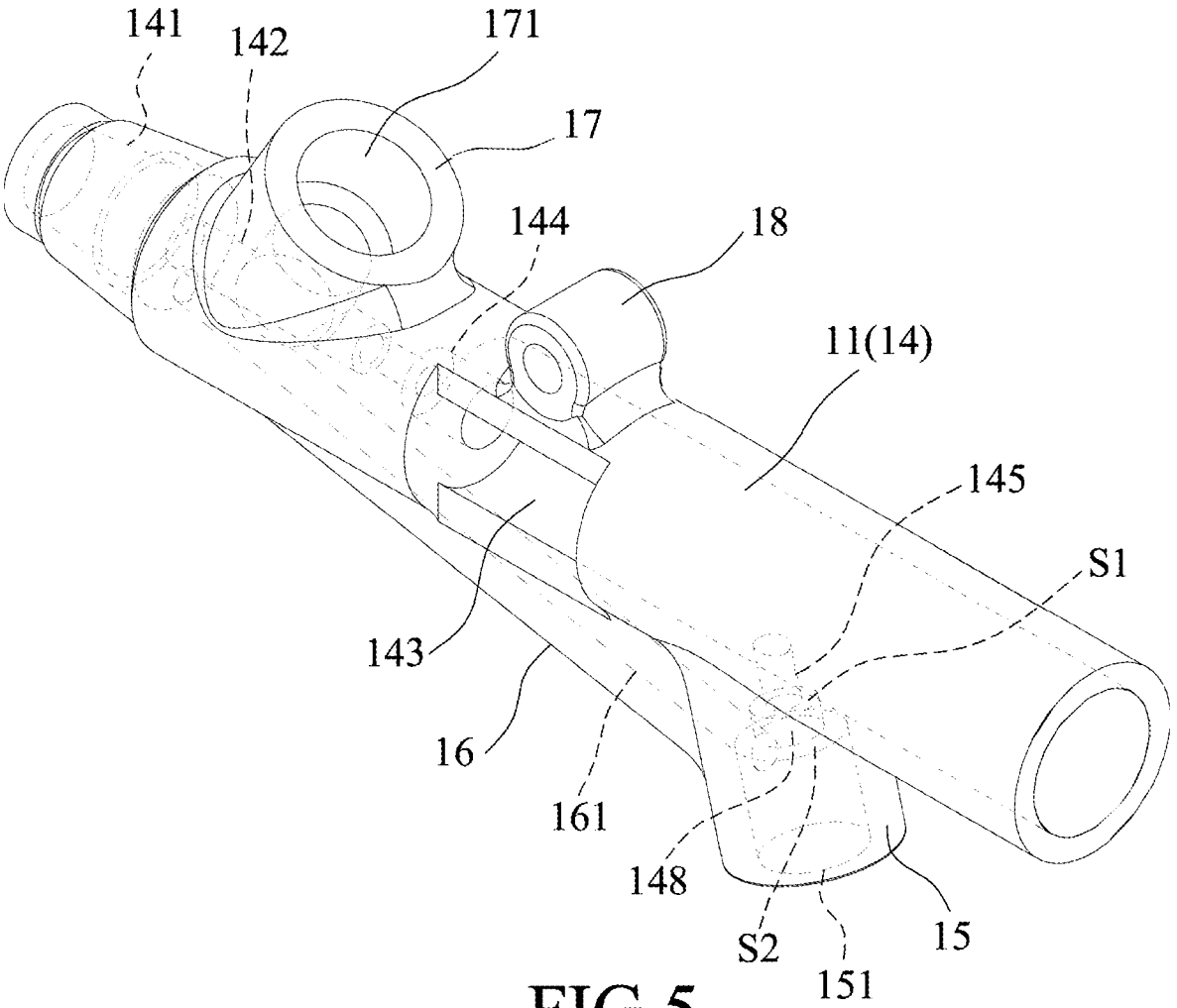
FIG. 5 is a perspective view of a gun body of the embodiment.

As shown in FIG. 5, the gun body 11 is formed as a unitary one piece structure composed of a tubular body portion 14, a valve connection portion 15, an air passageway portion 16, a feed connection portion 17 and a trigger connection portion 18.

Figure 6:
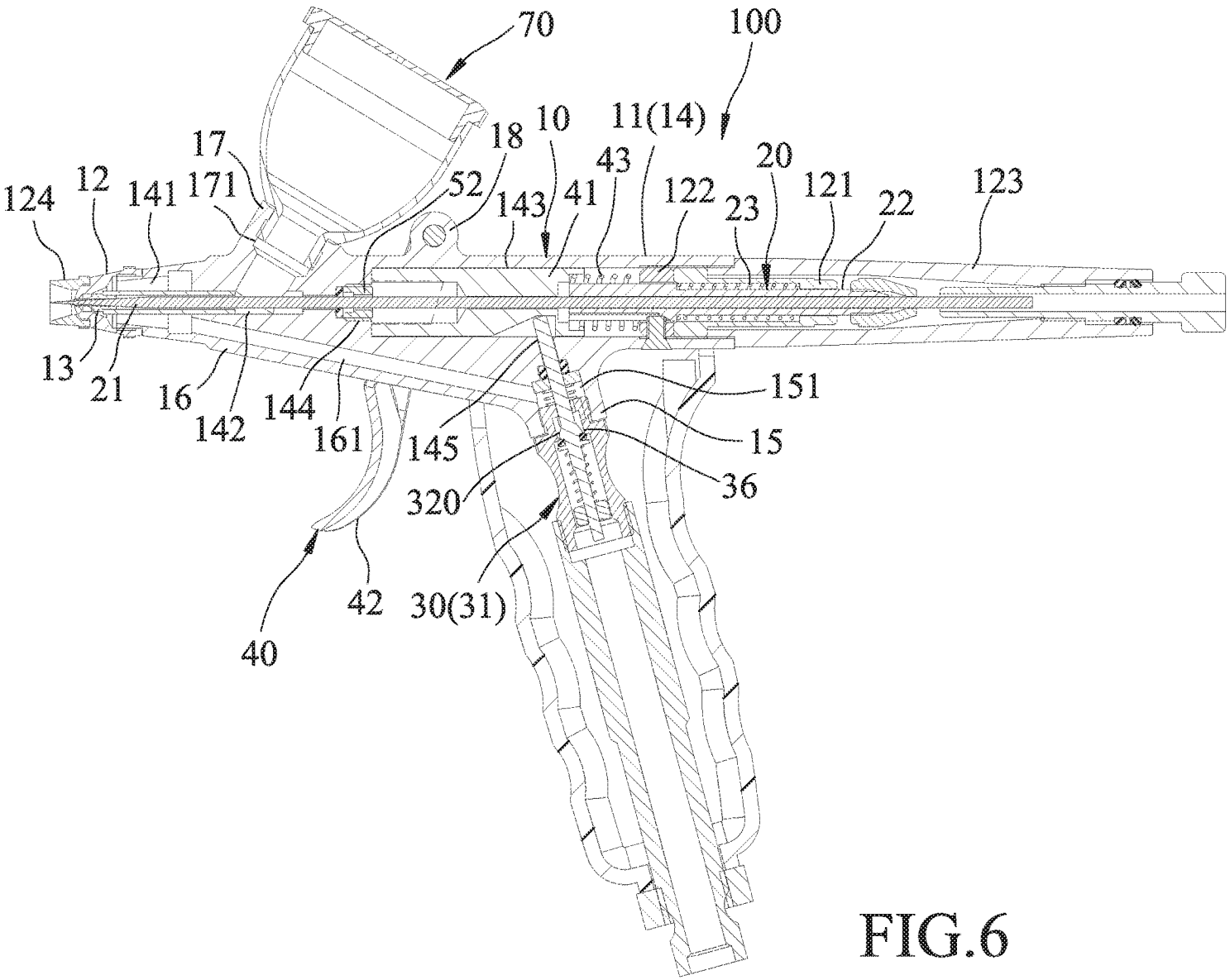
FIG. 6 is a sectional view of the embodiment with a spray unit at a non-delivery position, an air valve unit at a close state, and a slide member at an initial position.
Figure 7:
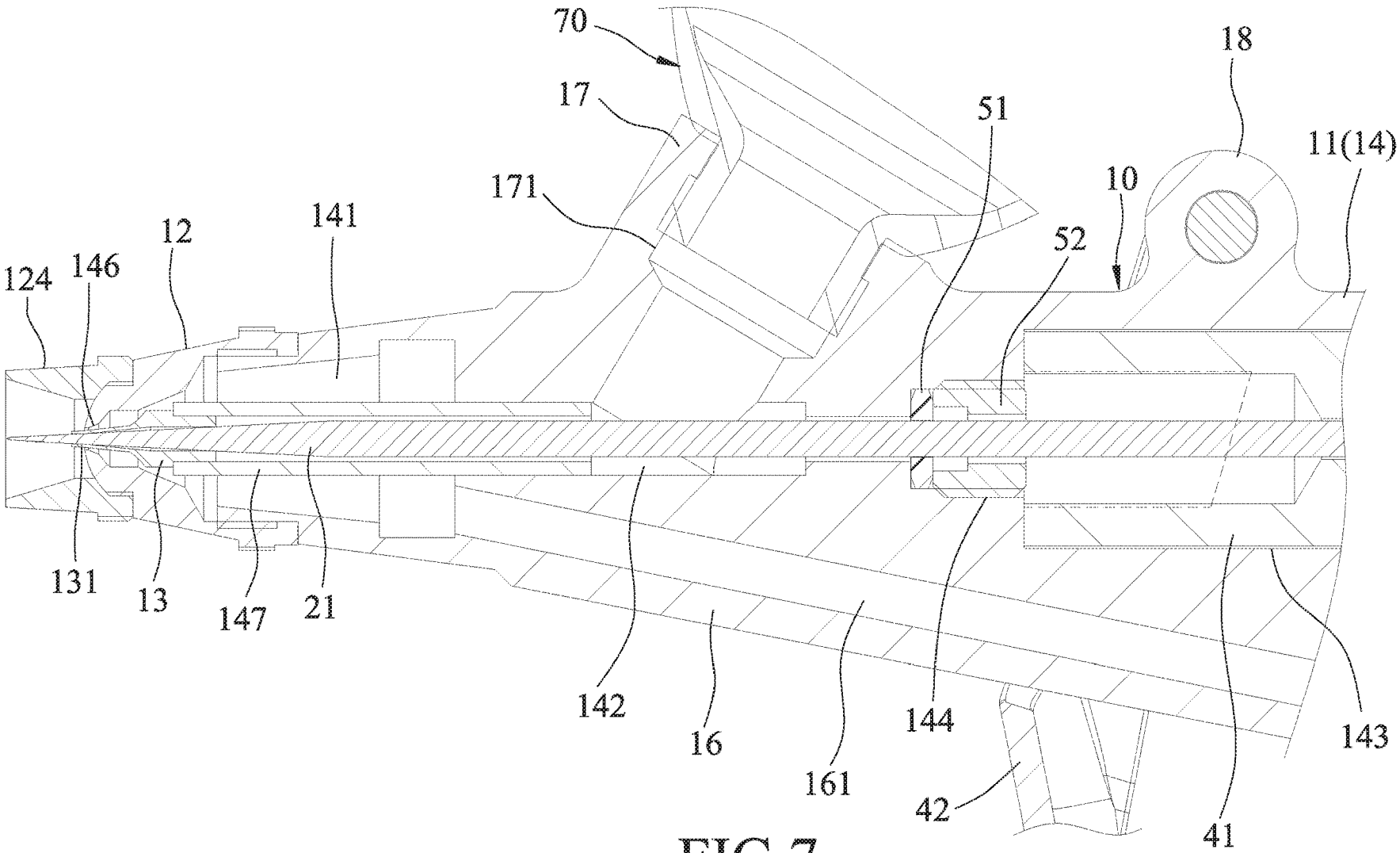
FIG. 7 is an enlarged view of a region of the sectional view shown in FIG. 6.
Figure 8:
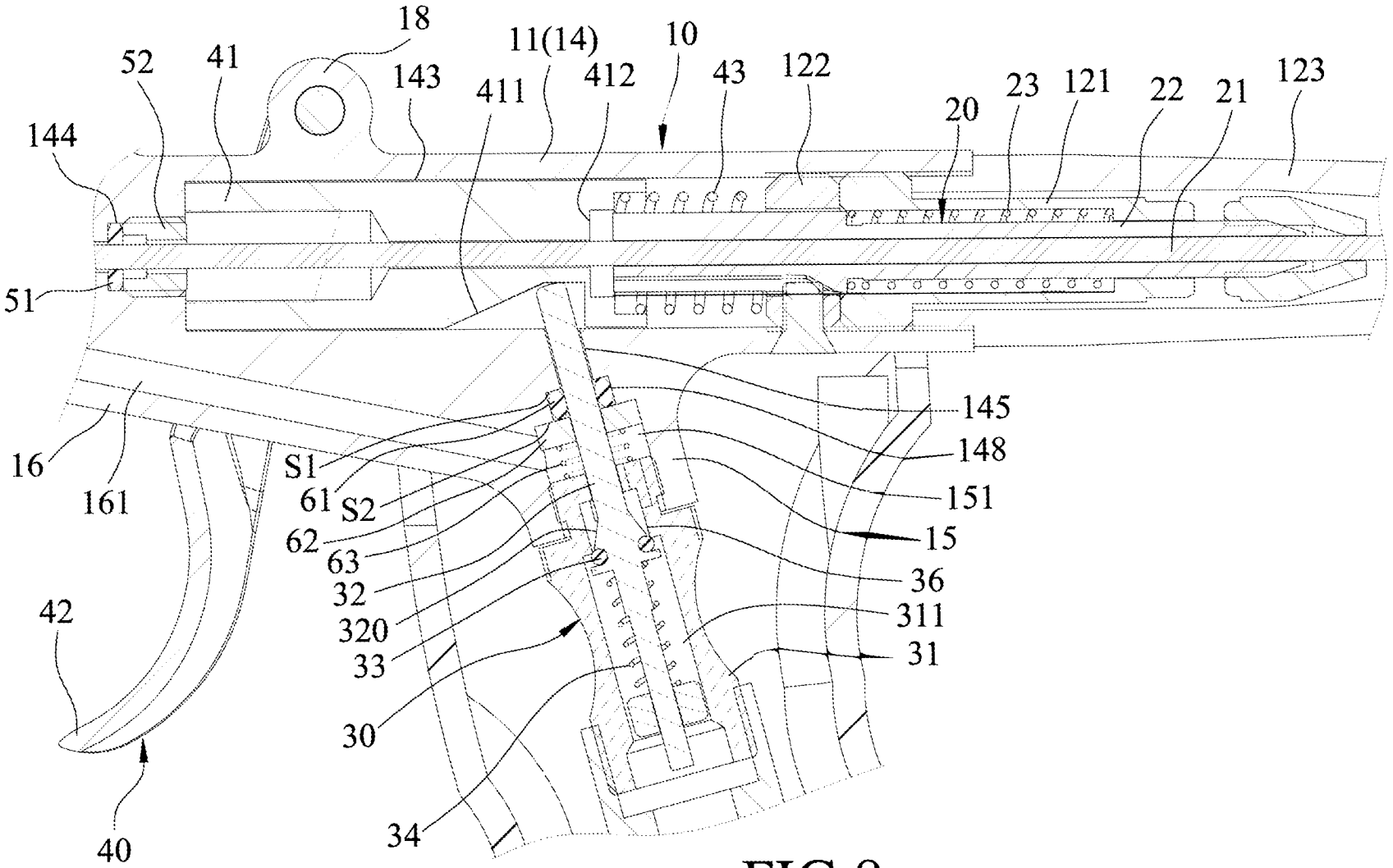
FIG. 8 is an enlarged view of another region of the sectional view shown in FIG. 6.

As shown in FIGS. 6 to 8, the spray cap 12 is removably disposed in a tubular front end of the tubular body portion 14 and has a cap opening 146. The tubular body portion 14 has an air chamber 141 that is disposed inside the tubular front end and covered by the spray cap 12 and that communicates with the cap opening 146, a feed passage 142 connected to a rear end of the air chamber 141, a feed tube 147 disposed in the air chamber 141 and the feed passage 142, a needle operating space 143 disposed rearwardly of the feed passage 142 and opening at a tubular rear end of the tubular body portion 14, and a gasket receiving passage 144 disposed between the feed passage 142 and the needle operating space 143. In this embodiment, a rear end of the feed tube 147 fluidly communicates the feed passage 142. The feed tube 147 fluidly disconnects the air chamber 141.

The valve connection portion 15 is integrally formed with and extends downwardly from a bottom side of the tubular body portion 14. The valve connection portion 15 has a valve connecting hole 151. In addition, the tubular body portion 14 further has a valve shaft passage 145 disposed between and directly connecting the needle operating space 143 and the valve connecting hole 151 of the valve connection portion 15, and a middle hole 148 disposed between the valve shaft passage 145 and the valve connecting hole 151. The middle hole 148 has a cross section larger than the valve shaft passage 145 and smaller than the valve connecting hole 151. As shown in FIG. 5, a first shoulder (S1) is formed at a junction of the valve shaft passage 145 and the middle hole 148, and a second shoulder (S2) is formed at a junction of the middle hole 148 and the valve connecting hole 151.

The air passageway portion 16 is integrally formed with and extends downwardly from the bottom side of the tubular body portion 14 and connects the valve connection portion 15, and has an air passageway 161 in fluid communication with the valve connecting hole 151 and the air chamber 141.

The feed connection portion 17 is integrally formed with and extends upwardly from the top side of the tubular body portion 14, and has a feed inlet hole 171 in communication with the feed passage 142.

The trigger connection portion 18 is integrally formed with and extends upwardly from the top side of the tubular body portion 14.

In this embodiment, the spring cap 121 is disposed in the tubular rear end of the tubular body portion 14 and extends into the needle operating space 143. The stop member 122 is disposed in the needle operating space 143 in front of the spring cap 121. The tail cap 123 is connected to the tubular rear end of the tubular body portion 14 and covers the spring cap 121. The needle cap 124 is removably connected to a front end of the spray cap 12.

The nozzle 13 is received in the spray cap 12 and a front end of the feed tube 147, and has a nozzle tip 131 extending into the cap opening 146. By virtue of the feed tube 147 disposed in the air chamber 141 and the feed passage 142, the nozzle 13 fluidly communicates the feed passage 142 and fluidly disconnects the air chamber 141. In this embodiment, the nozzle 13 further has a nozzle rear end that is opposite to the nozzle tip 131 and that fluidly connects a front end of the feed tube 147.

The spray unit 20 includes a spray needle 21, a needle sleeve 22 and a first resilient member 23. The spray needle 21 extends in the feed passage 142, the feed tube 147 and the nozzle tip 131. The needle sleeve 22 is sleeved on the spray needle 21, is movably disposed in the needle operating space 143, and extends rearwardly and outwardly of the spring cap 121. The first resilient member 23 is disposed in the spring cap 121 and around the spray needle 21, and abuts the needle sleeve 22.

The spray needle 21 is movable axially within the tubular body portion 14 between a non-delivery position (see FIGS. 6 and 7), where the spray needle 21 closes the nozzle tip 131, and a delivery position (see FIGS. 10 and 11), where the spray needle 21 opens the nozzle tip 131.

The first resilient member 23 provides a pushing force to move forwardly the needle sleeve 22, which brings the spray needle 21 to the non-delivery position. In this embodiment, the first resilient member 23 is a compression spring.

The air valve unit 30 includes a valve housing 31, a valve shaft 32, a stopper seal ring 33 and a valve spring 34. The valve housing 31 is connected to and inserted into the valve connecting hole 151 of the valve connection portion 15, and has an air supply valve passage 311. The valve shaft 32 extends movably through the air supply valve passage 311 of the valve housing 31 into the needle operating space 143 of the tubular body portion 14. The stopper seal ring 33 is sleeved around said valve shaft 32. The valve spring 34 is disposed in the air supply valve passage 311, and abuts the valve housing 31 and the valve shaft 32 to urge the valve shaft 32 to move into the needle operating space 143. In this embodiment, the valve housing 31 further has a valve seat 36 formed around the valve shaft 32. The valve shaft 32 has a generally conical stopper portion 320 proximal to the valve seat 36. The stopper seal ring 33 is sleeved on the stopper portion 320.

Figure 9:
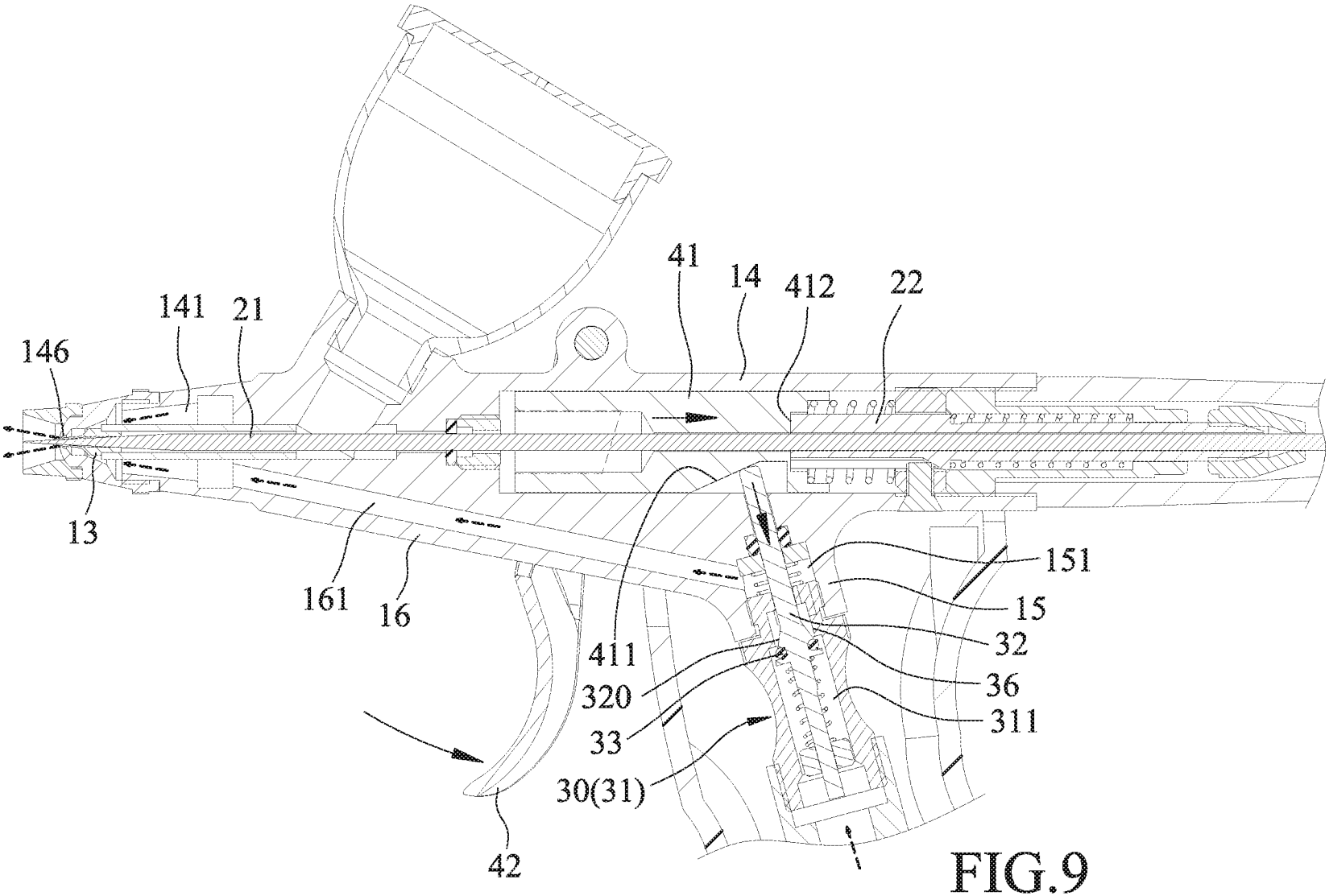
FIG. 9 is a sectional view of the embodiment illustrating the spray unit at a non-delivery position, the air valve unit at an open state, and the slide member at a first operating position.

The air valve unit 30 is transitionable between a closing state (see FIG. 8) where the air valve unit 30 has no fluid communication with the valve connecting hole 151, and an opening state (see FIG. 9) where the air valve unit 30 is in communication with the valve connecting hole 151. As shown in FIG. 8, when the air valve unit 30 is in the closing state, the stopper seal ring 33 is seated on the valve seat 36, thereby interrupting an air flow passing through the air supply valve passage 311. As shown in FIG. 9, when the air valve unit 30 is in the opening state, the stopper seal ring 33 moves away from the valve seat 36 and does not interrupt the air flow passing through the air supply valve passage 311.

As shown in FIGS. 4 and 8, the operation unit 40 is disposed on the gun body 11. The operation unit 40 includes a slide member 41, a trigger 42 and a second resilient member 43. The slide member 41 is sleeved around the spray needle 21 forwardly of the needle sleeve 22 and is slidable within the needle operating space 143. The trigger 42 is pivotally connected to the trigger connection portion 18 and is engageable with the slide member 41. The second resilient member 43 is disposed in abutment between the slide member 41 and the stop member 122. In addition, the slide member 41 has a valve-actuating push surface 411 and a rear push surface 412. The valve-actuating push surface 411 is in contact with an end of the valve shaft 32 and extends into the needle operating space 143. The rear push surface 412 faces the needle sleeve 22. The second resilient member 43 is a compression spring.

Figure 10:
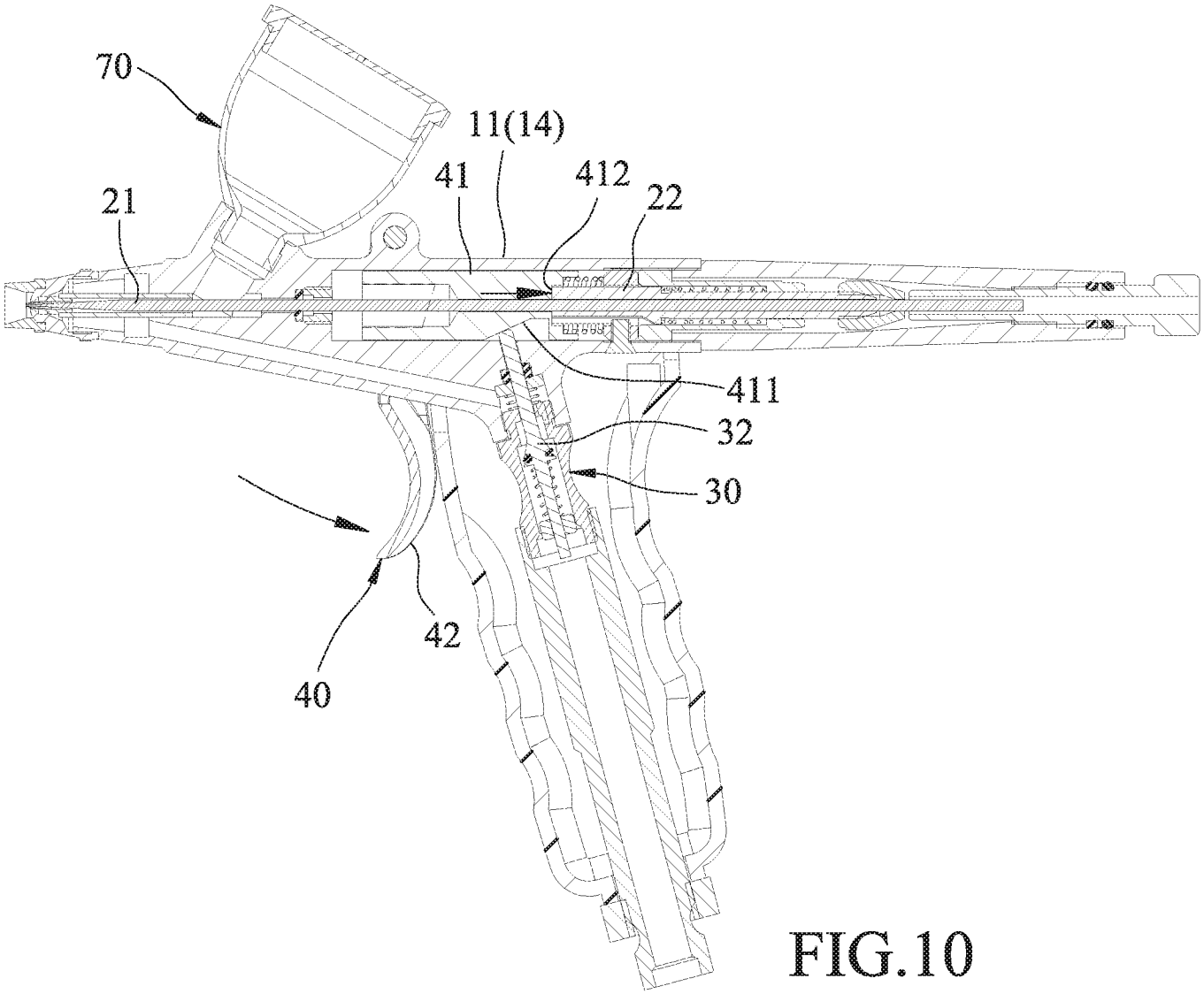
FIG. 10 is a sectional view of the embodiment illustrating the spray unit at a delivery position, the air valve unit at the open state, and the slide member at a second operating position.

The slide member 41 is actuated by the trigger 42 to move to an initial position (see FIG. 6), a first operating position (see FIG. 9), or a second operating position (see FIG. 10). The second resilient member 43 urges the slide member 41 to return to the initial position.

As shown in FIGS. 6 and 8, when the slide member 41 is at the initial position, the rear push surface 412 is spaced apart from the needle sleeve 22, the valve-actuating push surface 411 contacts with but does not push the valve shaft 32, the spray needle 21 is at the non-delivery position, and the air valve unit 30 in the closing state.

As shown in FIG. 9, when the slide member 41 is at the first operating position, the rear push surface 412 contacts with but does not push the needle sleeve 22, the spray needle 21 is at the non-delivery position, and the valve-actuating push surface 411 presses the valve shaft 32 such that the air valve unit 30 transitions from the closing state (see FIG. 8) to the opening state (see FIG. 9).

Figure 11:
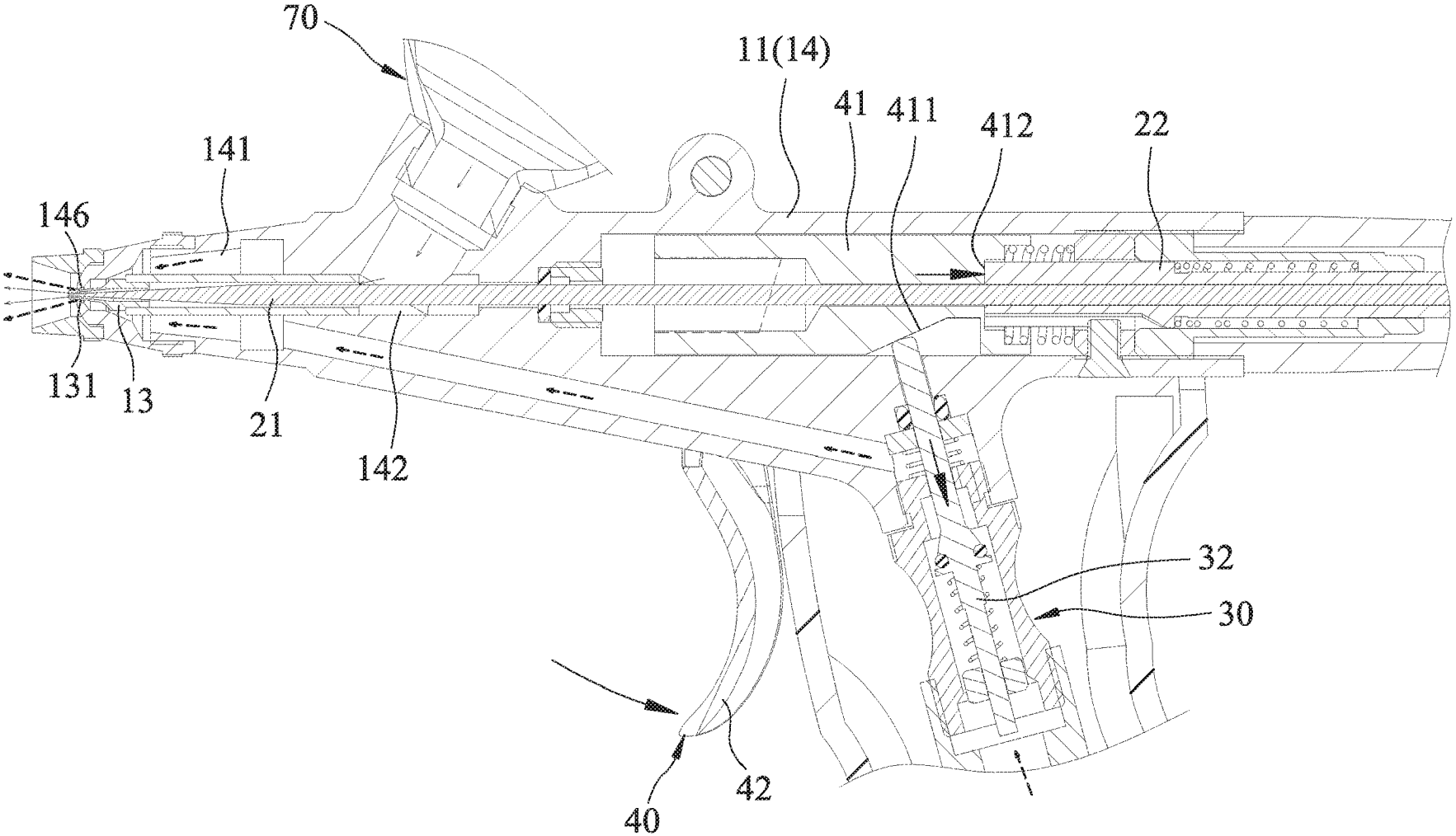
FIG. 11 is an enlarged fragmentary view of the sectional view shown in FIG. 10.

As shown in FIGS. 10 and 11, when the slide member 41 is at the second operating position, the valve-actuating push surface 411 presses the valve shaft 32 such that the air valve unit 30 is in the fully opening state, and the rear push surface 412 pushes the needle sleeve 22 to move the spray needle 21 from the non-delivery position (see FIG. 6) to the delivery position (see FIG. 10).

As shown in FIGS. 6 and 7, the gun unit 10 further includes a feed passage gasket 51 and a limiting ring 52. The feed passage gasket 51 is disposed within the gasket receiving passage 144 to seal the feed passage 142 from the needle operating space 143. The limit ring 52 is threadedly secured within the gasket receiving space 144 to position the feed passage gasket 51. The spray needle 21 extends through the limit ring 52 and the feed passage gasket 51 into the feed passage 142. The feed passage gasket 51 is a Teflon gasket and prevents external air from being drawn into the feed passage 142 and being mixed with a paint material fed into the feed passage 142. In addition, the feed passage gasket 51 prevents the paint material in the feed passage 142 from flowing into the needle operating space 143.

As shown in FIG. 6, the paint cup 70 is removably connected to the feed inlet hole 171 of the paint connection portion 17 in communication with the feed passage 142.

As shown in FIG. 8, the air valve unit 30 further includes a valve seal ring 61, a packing plate 62 and a compression spring 63. The valve seal ring 61 is disposed within the middle hole 148 in abutment with the first shoulder (S1). The packing plate 62 is disposed within the valve connecting hole 151 and abuts the valve seal ring 61. The compression spring 63 is disposed in the valve connecting hole 151 and abuts the packing plate 62 and the valve housing 31. The compression spring 63 urges the packing plate 62 to automatically abut the second shoulder (S2) and the valve seal ring 61 so that the valve seal ring 61 abuts the first shoulder (S1) and is immobilized in the middle hole 148. The valve shaft 32 extends through the compression spring 63, the packing plate 62, the valve seal ring 61 and the valve shaft hole 145 from the air supply valve passage 311 into the needle operating space 143. In this embodiment, the valve seal ring 61 prevents high pressure air input by the air valve unit 30 into the valve connecting hole 151 from flowing into the needle operating space 143 through the valve shaft passage 145. This ensures that the high pressure air sprayed out of the cap opening 146 has sufficient pressure (see FIG. 7).

When the slide member 41 is actuated by the trigger 42 to move from the initial position (see FIG. 6) to the first operation position (see FIG. 9), the air valve unit 30 transitions to the opening state by the valve-actuating push surface 411 that pushes the valve shaft 32. Therefore, high pressure air input from an air pressure source, e.g. an air compressor (not shown), into the air supply valve passage 311 enters the air chamber 141 through the valve connecting hole 151 and the air passageway 161, flows externally around the nozzle 13, and is sprayed out of the cap opening 146 to remove dust on an object (not shown) for being painted. Because the spray needle 21 is at the non-delivery position, it prevents paint from being sprayed out of the nozzle tip 131.

When the slide member 41 is actuated by the trigger 42 to move from the first operation position (see FIG. 9) to the second operation position (see FIGS. 10 and 11), not only does the valve-actuating push surface 411 press the valve shaft 32 to place the air valve unit 30 in the fully opening state, but the rear push surface 412 pushes the needle sleeve 22 to move the spray needle 21 to the delivery position such that the spray needle 21 opens the nozzle tip 131. Because the high pressure air is sprayed out of the cap opening 146, pressure drops around the nozzle 13, and the paint in the paint cup 70 is drawn into the nozzle 13 through the feed passage 142 and is atomized from the nozzle tip 131 onto the object to be painted.

The paint spray gun 100 has the following advantages:

1. The gun body 11 is formed as a unitary one piece structure which may be made by forging and injection molding, followed by subsequent processes for forming internal spaces and passages. Compared with the prior art, because the gun body 11 does not require any welding operations, it can be easily manufactured to reduce manufacture costs, and also possesses good appearance.

2. Compared with the prior art, because the valve connection portion 15 is integrally formed with the tubular body portion 14, and because the air passageway portion 16 is integrally formed with the tubular body portion 14 and the valve connection portion 15, when the high pressure air is delivered to the air chamber 141 from the valve connecting hole 151 through the air passageway 161, leakage of high pressure air can be avoided. Therefore, the high pressure air input from the air valve unit 30 is ensured to be stable and sufficient around the nozzle 13, and the paint can be uniformly and sufficiently atomized for effectively enhancing aesthetic appearance and integrity of painted products. In addition, the gun body 11 prevents air leakages and avoids extra load on the air compressor to save energy.

3. Because the feed connection portion 17 is integrally formed with the tubular body portion 14, when paint flows from the paint cup 70 to the feed passage 142, leakage of the paint is prevented. In addition, the external air is effectively prevented from being mixed with the paint through a joint of the feed connection portion 17 and tubular body portion 14. During a spray paint operation, not only is the paint continuously sprayed, but rough or incomplete atomization of the paint is prevented, thereby effectively enhancing aesthetic appearance of the painted products.

4. Because the gun body 11 is formed as a unitary one piece structure without welded joints, selection of a material for manufacturing the gun body 11 is not limited to the welding operations. Aside from cooper, an aluminum alloy may be used to manufacture the gun body 11 to reduce weight.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A paint spray gun, comprising:

a gun unit including a gun body, a spray cap and a nozzle, said gun body being formed as a unitary one piece structure composed of a tubular body portion, a valve connection portion, an air passageway portion and a feed connection portion, said spray cap disposed on a tubular front end of said tubular body portion and having a cap opening, said tubular body portion having an air chamber that is disposed inside said tubular front end and covered by said spray cap and that communicates with said cap opening, and a feed passage connected to a rear end of said air chamber, said valve connection portion being integrally formed with and extending downwardly from a bottom side of said tubular body portion, said valve connection portion having a valve connecting hole, said air passageway portion being integrally formed with and extending downwardly from said bottom side of said tubular body portion and said valve connection portion, and having an air passageway in fluid communication with said valve connecting hole and said air chamber, said feed connection portion being integrally formed with and extending upwardly from a top side of said tubular body portion, and having a feed inlet hole in communication with said feed passage, said nozzle being received in said spray cap and having a nozzle tip extending into said cap opening, said nozzle fluidly communicating said feed passage;

a spray unit including a spray needle that extends in said feed passage and said nozzle tip, said spray needle being movable axially within said tubular body portion between a non-delivery position, where said spray needle closes said nozzle tip, and a delivery position where said spray needle opens said nozzle tip;

an air valve unit connected to said valve connection portion, said air valve unit being transitionable between a closing state where said air valve unit has no fluid communication with said valve connecting hole, and an opening state where said air valve unit is in communication with said valve connecting hole; and an operation unit disposed on said gun body, said operation unit driving said spray needle to move between the non-delivery position and the delivery position, and actuating said air valve unit to transition between the closing state and the opening state;

wherein said gun unit further includes a spring cap disposed in a tubular rear end of said tubular body portion;

wherein said tubular body portion further has a needle operating space disposed rearwardly of said feed passage and opening at said tubular rear end;

wherein said spray unit further includes a needle sleeve sleeved on said spray needle and disposed in said needle operating space, and a first resilient member that is disposed in said spring cap and around said spray needle and that abuts said needle sleeve;

wherein said first resilient member provides a pushing force to move forwardly said needle sleeve which brings said spray needle to the non-delivery position;

wherein said gun unit further includes a stop member disposed in said needle operating space in front of said spring cap;

wherein said gun body further has a trigger connection portion that is integrally formed with and extends upwardly from said top side of said tubular body portion;

wherein said operation unit includes a slide member that is sleeved around said spray needle forwardly of said needle sleeve and that is slidable within said needle operating space, a trigger that is pivotally connected to said trigger connection portion and that is engageable with said slide member, and a second resilient member disposed in abutment between said slide member and said stop member;

wherein said air valve unit includes a valve housing that is connected to said valve connecting hole and that has an air supply valve passage, a valve shaft that extends through said air supply passage of said valve housing into said needle operating space of said tubular body portion, a stopper seal ring sleeved around said valve shaft, and a valve spring disposed in said air supply valve passage and abutting said valve housing and said valve shaft to urge said valve shaft to move into said needle operating space;

wherein said tubular body portion further has a valve shaft passage disposed between said needle operating space and said valve connecting hole of said valve connection portion, and a middle hole disposed between said valve shaft passage and said valve connecting hole, said valve shaft passage disposed between and directly connecting said needle operating space and said middle hole, said middle hole having a cross section larger than that of said valve shaft passage and smaller than that of said valve connecting hole so that a first shoulder is formed at a junction of said valve shaft passage and said middle hole and a second shoulder is formed at a junction of said middle hole and said valve connecting hole;

wherein said air valve unit further includes a valve seal ring disposed within said middle hole, a packing plate that is disposed within said valve connecting hole and abuts said valve seal ring, and a compression spring that abuts said packing plate and said valve housing and that urges said packing plate to abut against said valve seal ring so that said valve seal ring abuts said first shoulder and is immobilized in said middle hole;

wherein said valve shaft extends through said compression spring, said packing plate, said valve seal ring and said valve shaft passage from said air supply passage into said needle operating space;

wherein said slide member has a valve-actuating push surface in contact with an end of said valve shaft extending into said needle operating space; and wherein a section of said valve shaft extends through said valve shaft passage and is in sliding contact with an inner boundary surface of said valve shaft passage.

2. The paint spray gun as claimed in claim 1, wherein:

said gun unit further has a gasket receiving passage disposed between said feed passage and said needle operating space, a feed passage gasket disposed within said gasket receiving passage to seal said feed passage from said needle operating space, and a limit ring that is secured within said gasket receiving space to position said feed passage gasket; and said spray needle extends through said limit ring and said feed passage gasket.

3. The paint spray gun as claimed in claim 2, wherein each of said first resilient member and said second resilient member is a compression spring.

4. The paint spray gun as claimed in claim 1, wherein said valve housing further has a valve seat formed around said valve shaft, said valve shaft having a stopper portion proximal to said valve seat, said stopper seal ring being sleeved on said stopper portion.

5. The paint spray gun as claimed in claim 1, further comprising a paint cup connected to said paint connection portion of said gun body.

6. The paint spray gun as claimed in claim 1, wherein said tubular body portion further has a feed tube that is disposed in said air chamber and said feed passage, said nozzle further having a nozzle rear end that is opposite to said nozzle tip and that fluidly connects a front end of said feed tube, a rear end of said feed tube fluidly communicating said feed passage.

7. The paint spray gun as claimed in claim 1, wherein said gun body is made from an aluminum alloy.

* * * * *